US006833484B2

(12) United States Patent
O'Rear

(10) Patent No.: US 6,833,484 B2
(45) Date of Patent: Dec. 21, 2004

(54) INHIBITING OXIDATION OF A FISCHER-TROPSCH PRODUCT USING PETROLEUM-DERIVED PRODUCTS

(75) Inventor: Dennis J. O'Rear, Petaluma, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 176 days.

(21) Appl. No.: 09/882,709

(22) Filed: Jun. 15, 2001

(65) Prior Publication Data

US 2002/0193646 A1 Dec. 19, 2002

(51) Int. Cl.[7] ..... C10M 111/00

(52) U.S. Cl. ..... 585/1; 585/2; 585/3; 585/4; 585/13; 508/110; 508/561; 508/584; 208/14; 208/19

(58) Field of Search ..... 585/1

(56) References Cited

U.S. PATENT DOCUMENTS

| | | | | | |
|---|---|---|---|---|---|
| 2,712,526 | A | | 7/1955 | McDermott | |
| 4,568,663 | A | | 2/1986 | Mauldin | |
| 5,453,211 | A | | 9/1995 | Alward | |
| 6,080,301 | A | * | 6/2000 | Berlowitz et al. | 208/18 |
| 6,103,099 | A | * | 8/2000 | Wittenbrink et al. | 208/27 |
| 6,162,956 | A | * | 12/2000 | Berlowitz et al. | 585/14 |
| 6,165,949 | A | * | 12/2000 | Berlowitz et al. | 508/363 |
| 6,180,842 | B1 | * | 1/2001 | Berlowitz et al. | 585/1 |
| 6,274,029 | B1 | * | 8/2001 | Wittenbrink et al. | 208/15 |
| 6,332,974 | B1 | * | 12/2001 | Wittenbrink et al. | 208/18 |
| 6,369,286 | B1 | * | 4/2002 | O'Rear | 585/644 |

FOREIGN PATENT DOCUMENTS

| | | |
|---|---|---|
| EP | 0 427 456 A1 | 5/1991 |
| EP | 0609079 A1 | 8/1994 |
| GB | 1123521 | 8/1968 |
| WO | 00/11116 A1 | 3/2000 |
| WO | 00/11117 A1 | 3/2000 |

OTHER PUBLICATIONS

Smalheer and Smith, "Lubricant Additives", Section I–Chemistry of Additives, pp. 1–11, 1967.*

Gruse, W.A. and Stevens, D.R., *Chemical Technology of Petroleum*, Third Edition, 1960, pp. 299–304, McGraw–Hill Book Company, Inc., New york.

United Kingdom search report dated Jan. 31, 2003.

Klemchuk P.P., "Antioxidants" in: Ullmann's Encyclopedia of Industrial Chemistry, 5$^{th}$ edition, vol. A3, 1985, p. 105, para 4.2.

Netherlands Search Report dated Jan. 9, 2003.

WPI Abstract Accession No. 1989–328853 [45] and JP 1245092 A (Mitsubishi), Mar. 23, 1988.

WPI Abstract Accession No. 1997–200734 [18] and RU 2066341 c (N PROIZV), Oct. 28, 1994.

United Kingdom Search Report mailed Dec. 9, 2003.

* cited by examiner

*Primary Examiner*—Ellen M. McAvoy
(74) *Attorney, Agent, or Firm*—Burns, Doane, Swecker & Mathis, L.L.P.

(57) ABSTRACT

The present invention relates blended hydrocarbonaceous products comprising Fischer Tropsch derived products that resist oxidation and to methods of inhibiting oxidation in Fischer Tropsch products. The present invention also relates to Fischer Tropsch products containing an effective amount of a petroleum-derived hydrocarbonaceous product such that the Fischer Tropsch product resists oxidation.

16 Claims, No Drawings

INHIBITING OXIDATION OF A FISCHER-TROPSCH PRODUCT USING PETROLEUM-DERIVED PRODUCTS

FIELD OF THE INVENTION

The present invention relates to methods of inhibiting oxidation in Fischer Tropsch derived products. The present invention also relates to Fischer Tropsch derived products containing an effective amount of a petroleum-derived hydrocarbonaceous product such that the Fischer Tropsch derived product resists oxidation.

BACKGROUND OF THE INVENTION

The majority of combustible fuel used in the world today is derived from crude oil. There are several limitations to using crude oil as a fuel source. Crude oil is in limited supply; it includes aromatic compounds that may be harmful and irritating, and it contains sulfur and nitrogen-containing compounds that can adversely affect the environment, for example, by producing acid rain.

Combustible liquid fuels can also be prepared from natural gas. This preparation involves converting the natural gas, which is mostly methane, to synthesis gas, or syngas, which is a mixture of carbon monoxide and hydrogen. An advantage of using products prepared from syngas is that they do not contain nitrogen and sulfur and generally do not contain aromatic compounds. Accordingly, they have minimal health and environmental impact.

Fischer-Tropsch chemistry is typically used to convert the syngas to a product stream that includes combustible fuel, among other products. These Fischer Tropsch products have very low levels of sulfur, nitrogen, aromatics and cycloparaffins. The Fischer Tropsch derived fuels are considered "green fuels" and are desirable as environmentally friendly.

Although environmentally friendly, these Fischer Tropsch products tend to oxidize relatively rapidly when exposed to air. The rapid oxidation may be due to a lack natural anti-oxidants, such as sulfur compounds. Further, some of the products produced by the Fischer Tropsch process may be waxy, and these products are frequently are shipped at elevated temperature. Shipping at elevated temperatures increases the tendency of Fischer Tropsch products to oxidize.

Various methods have been proposed to protect Fischer Tropsch products from oxidation during shipping and storage. For example, Berlowitz and Simon of Exxon Research and Engineering Company describe in World Patent Application Nos. WO 00/11116A1 and WO 00/11117A1 the blending of a Fischer Tropsch derived diesel fuel with high boiling sulfur containing streams, derived from gas field condensate or hydrotreated streams. Using the approach of Berlowitz and Simon to prevent oxidation adds high-boiling, sulfur-containing compounds to the Fischer Tropsch diesel fuel. Therefore, the products of Berlowitz and Simon contain sulfur, which prevents their use as low-sulfur, environmentally friendly fuels. Another undesirable feature of the products of Berlowitz and Simon is that a significant portion of the sulfur in those products is in the form of mercaptans (RSH). Mercaptans are well known to cause corrosion. Therefore, when shipping or storing products treated according to Berlowitz and Simon, corrosion of the large storage vessels can be a problem. Corrosion damage may lead to the need for eventual replacement of the large, expensive vessels used to ship and store hydrocarbonaceous products.

Various other well-known antioxidants may be used with Fischer Tropsch diesel fuels to prevent oxidation. These well-known antioxidants may include phenolic compounds and diphenylamine compounds. However, these antioxidants can be expensive when used on a large scale and must be transported to the remote site where the Fischer Tropsch diesel fuel is made.

There is a need for hydrocarbonaceous products comprising Fischer Tropsch derived products that are capable of resisting oxidation. There is a need for efficient and economical methods of inhibiting oxidation of Fischer Tropsch derived products.

SUMMARY OF THE INVENTION

The invention relates to hydrocarbonaceous products comprising Fischer Tropsch derived products that are capable of resisting oxidation. One aspect of the present invention is a blended hydrocarbonaceous product comprising: a) a Fischer Tropsch derived product; and b) an effective amount of a petroleum-derived hydrocarbonaceous product such that the blended hydrocarbonaceous product has a final peroxide number of less than 5 ppm, preferably less than 3 ppm, and most preferably less than 1 ppm after 7 days. A preferred Fischer Tropsch product of the present invention has a branching index of less than five, preferably less than four, more preferably less than three.

Another aspect of the present invention is a blended hydrocarbonaceous product comprising: a) a Fischer Tropsch derived product; b) a petroleum-derived hydrocarbonaceous product; and c) an effective amount of an antioxidant selected from the group consisting of phenolic compounds, diphenylamine compounds and combinations thereof, such that the blended hydrocarbonaceous product has a final peroxide number of less than 5 ppm, preferably less than 3 ppm, and most preferably less than 1 ppm after 7 days; and wherein the effective amount of antioxidant in (a) and (b) is less than the amount that would be required in (a) alone. A preferred Fischer Tropsch product of the present invention has a branching index of less than five, preferably less than four, more preferably less than three.

An additional aspect of the present invention is a method of inhibiting oxidation of a Fischer Tropsch product comprising the steps of:

a) synthesizing a Fischer Tropsch product by a Fischer Tropsch process;

b) adding an effective amount of a petroleum-derived hydrocarbonaceous product to the Fischer Tropsch product to provide a blended product having a final peroxide number of less than 5 ppm, preferably less than 3 ppm and most preferably less than 1 ppm after 7 days; and c) mixing the petroleum-derived hydrocarbonaceous product into the Fischer Tropsch product.

The method may also comprise the step of processing the mixture with hydrogen (i.e., hydrotreating, hydrocracking, and hydroisomerization) to remove at least a portion of sulfur and other impurities that originate from the conventional fuel component after the period in which oxidation is to be prevented.

A further aspect of the present invention is a method of inhibiting oxidation of a Fischer Tropsch product comprising the steps of:

a) synthesizing a Fischer Tropsch product by a Fischer Tropsch process;

b) adding an amount of a petroleum-derived hydrocarbonaceous product which contains sulfur to the Fischer Tropsch product;

c) mixing the petroleum-derived hydrocarbonaceous product into the Fischer Tropsch product to provide a blended product; and d) processing the blended product with hydrogen to provide a final product with a sulfur content of less than 100 ppm, preferably less than 10 ppm and most preferably less than 1 ppm.

The step of processing the blended product may involve any process that may be used to remove at least a portion of sulfur and other impurities that originate from the petroleum-derived hydrocarbonaceous component, including for example, hydrotreating, hydrocracking, and hydroisomerization. The processing step may be performed after the period in which oxidation is to be prevented and before use of the products.

A further aspect of the present invention is a method of inhibiting oxidation of a Fischer Tropsch product comprising the steps of:

a) synthesizing a Fischer Tropsch product by a Fischer Tropsch process;

b) creating a blended hydrocarbonaceous product by mixing (i) the Fischer Tropsch product, (ii) a petroleum-derived hydrocarbonaceous product, and (iii) an effective amount of an antioxidant selected from the group consisting of phenolic compounds and diphenylamine compounds such that the blended hydrocarbonaceous product has a final peroxide number of less 5 ppm, preferably less than 3 ppm, and most preferably less than 1 ppm after 7 days; and wherein the effective amount of antioxidant in (i) and (ii) is less than the amount that would be required in (i) alone.

The method may also comprise the step of processing the mixture with hydrogen (i.e., hydrotreating, hydrocracking, and hydroisomerization) to remove at least a portion of sulfur and other impurities that originate from the conventional fuel component after the period in which oxidation is to be prevented.

DEFINITIONS

Unless otherwise stated, the following terms used in the specification and claims have the meanings given below:

Antioxidant" means any chemical compound that reduces the tendency of fuels to deteriorate by inhibiting oxidation.

"Branching index" means a numerical index for measuring the average number of side chains attached to a main chain of a compound. For example, a compound that has a branching index of two means a compound having a straight chain main chain with an average of approximately two side chains attached thereto. The branching index of a product of the present invention may be determined as follows. The total number of carbon atoms per molecule is determined. A preferred method for making this determination is to estimate the total number of carbon atoms from the molecular weight. A preferred method for determining the molecular weight is Vapor Pressure Osmometry following ASTM-2503, provided that the vapor pressure of the sample inside the Osmometer at 45° C. is less than the vapor pressure of toluene. For samples with vapor pressures greater than toluene, the molecular weight is preferably measured by benzene freezing point depression. Commercial instruments to measure molecular weight by freezing point depression are manufactured by Knauer. ASTM D2889 may be used to determine vapor pressure. Alternatively, molecular weight may be determined from a ASTM D-2887 or ASTM D-86 distillation by correlations which compare the boiling points of known n-paraffin standards.

The fraction of carbon atoms contributing to each branching type is based on the methyl resonances in the carbon NMR spectrum and uses a determination or estimation of the number of carbons per molecule. The area counts per carbon is determined by dividing the total carbon area by the number of carbons per molecule. Defining the area counts per carbon as "A", the contribution for the individual branching types is as follows, where each of the areas is divided by area A:

2–branches=half the area of methyls at 22.5 ppm/A

3–branches=either the area of 19.1 ppm or the area at 11.4 ppm (but not both)/A

4–branches=area of double peaks near 14.0 ppm/A

4+branches=area of 19.6 ppm/A minus the 4–branches internal ethyl branches=area of 10.8 ppm/A The total branches per molecule (i.e. the branching index) is the sum of areas above.

For this determination, the NMR spectrum is acquired under the following quantitative conditions: 45 degree pulse every 10.8 seconds, decoupler gated on during 0.8 sec acquisition. A decoupler duty cycle of 7.4% has been found to be low enough to keep unequal Overhauser effects from making a difference in resonance intensity.

In a specific example, the molecular weight of a Fischer Tropsch Diesel Fuel sample, based on the 50% point of 478° F. and the API gravity of 52.3, was calculated to be 240. For a paraffin with a chemical formula $C_nH_{2n+2}$, this molecular weight corresponds to an average number n of 17.

The NMR spectrum acquired as described above had the following characteristic areas:

2–branches=half the area of methyl at 22.5 ppm/A=0.30

3–branches=area of 19.1 ppm or 11.4 ppm not both/A=0.28

4–branches=area of double peaks near 14.0 ppm/A=0.32

4+branches=area of 19.6 ppm/A minus the 4–branches=0.14 internal ethyl branches=area of 10.8 ppm/A=0.21

The branching index of this sample was found to be 1.25.

"Fischer-Tropsch derived products" mean any hydrocarbonaceous products derived from a Fischer Tropsch process. Fischer Tropsch derived products include, for example, Fischer Tropsch naphtha, Fischer Tropsch jet fuel, Fischer Tropsch diesel fuel, Fischer Tropsch solvent, Fischer Tropsch lube base stock, Fischer Tropsch lube base oil, Fischer Tropsch LPG, Fischer Tropsch synthetic crude, and mixtures thereof.

"Hydrocarbonaceous" means containing hydrogen and carbon atoms and potentially also containing heteroatoms, such as oxygen, sulfur, nitrogen, and the like.

"Hydrocarbonaceous Product" means any hydrocarbonaceous product, including both petroleum-derived hydrocarbonaceous products and Fischer Tropsch products. Hydrocarbonaceous products contain hydrogen and carbon atoms and may also contain heteroatoms, such as oxygen, sulfur, nitrogen, and the like.

"Paraffin" means any saturated hydrocarbon compound, i.e., an alkane, with the formula $C_nH_{2n+2}$.

"Petroleum-Derived Hydrocarbonaceous Product" means any hydrocarbonaceous product that is derived from crude oil or conventional petroleum products derived from crude oil. Petroleum-derived hydrocarbonaceous products contain greater than 1 ppm sulfur. Petroleum-derived hydrocarbonaceous products may be derived from, for example, conventional petroleum, conventional diesel fuel, conventional solvent, conventional jet fuel, conventional naphtha, conventional lube base stock, conventional lube base oil, and mixtures thereof.

DETAILED DESCRIPTION OF ILLUSTRATIVE EMBODIMENTS

Hydrocarbonaceous products are typically stored or transported for a period of time before use. During storage and/or transport, hydrocarbonaceous products may be subject to conditions that promote oxidation. Oxidation during transport and storage and prior to use may cause many problems with ultimate use of the product. In particular, Fischer Tropsch products tend to oxidize relatively rapidly when exposed to air. The present invention relates to antioxidants that meet the increased need for effective antioxidants during shipment and storage of Fischer Tropsch products.

Fischer-Tropsch Process

Combustible liquid fuels can be prepared from natural gas through Fischer Tropsch processes. This preparation involves converting the natural gas, which is mostly methane, to synthesis gas, or syngas, which is a mixture of carbon monoxide and hydrogen.

Catalysts and conditions for performing Fischer-Tropsch synthesis are well known to those of skill in the art, and are described, for example, in EP 0 921 184 A1. In the Fischer-Tropsch synthesis process, liquid and gaseous hydrocarbons are formed by contacting a synthesis gas (syngas) comprising a mixture of $H_2$ and CO with a Fischer-Tropsch catalyst under suitable temperature and pressure reactive conditions. The Fischer-Tropsch reaction is typically conducted at temperatures of from about 300° to 700° F. (149° to 371° C.), preferably from about 400° to 550° F. (204° to 228° C.); pressures of from about 10 to 600 psia, (0.7 to 41 bars), preferably 30 to 300 psia, (2 to 21 bars) and catalyst space velocities of from about 100 to 10,000 cc/g/hr., preferably 300 to 3,000 cc/g/hr.

The products may range from $C_1$ to $C_{200+}$ with a majority in the $C_5$ to $C_{100+}$ range. The reaction can be conducted in a variety of reactor types, for example, fixed bed reactors containing one or more catalyst beds; slurry reactors; fluidized bed reactors; and a combination of different type reactors. Such reaction processes and reactors are well known and documented in the literature. Slurry Fischer-Tropsch processes, which is a preferred process in the practice of the invention, utilize superior heat (and mass) transfer characteristics for the strongly exothermic synthesis reaction and are able to produce relatively high molecular weight, paraffinic hydrocarbons when using a cobalt catalyst.

In a slurry process, a syngas comprising a mixture of $H_2$ and CO is bubbled up as a third phase through a slurry in a reactor which comprises a particulate Fischer-Tropsch type hydrocarbon synthesis catalyst dispersed and suspended in a slurry liquid comprising hydrocarbon products of the synthesis reaction which are liquid at the reaction conditions. The mole ratio of the hydrogen to the carbon monoxide may broadly range from about 0.5 to 4, but is more typically within the range of from about 0.7 to 2.75 and preferably from about 0.7 to 2.5. A particularly preferred Fischer-Tropsch process is taught in EP 0609079, incorporated herein by reference in its entirety.

Suitable Fischer-Tropsch catalysts comprise one or more Group VIII catalytic metals such as Fe, Ni, Co, Ru and Re. Additionally, a suitable catalyst may contain a promoter. Thus, a preferred Fischer-Tropsch catalyst comprises effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La_2O_3$, MgO, and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Support materials including alumina, silica, magnesia and titania or mixtures thereof may be used. Preferred supports for cobalt containing catalysts comprise titania. Useful catalysts and their preparation are known and illustrative, but non-limiting examples may be found, for example, in U.S. Pat. No. 4,568,663.

A preferred Fischer Tropsch product of the present invention has a branching index of less than five, preferably less than four, more preferably less than three. Fischer-Tropsch derived products include, for example, Fischer Tropsch naphtha, Fischer Tropsch jet fuel, Fischer Tropsch diesel fuel, Fischer Tropsch solvent, Fischer Tropsch lube base stock, Fischer Tropsch lube base oil, Fischer Tropsch LPG, Fischer Tropsch synthetic crude, and mixtures thereof.

Fischer Tropsch distillate fuels have excellent burning properties and are highly paraffinic. As a class, paraffins are the most biodegradable compounds found in petroleum and are preferentially metabolized by microbes. In Fischer Tropsch distillate fuels, paraffins are the majority components (greater than 50%) and can exceed 70% and even 95%.

An advantage of using fuels prepared from syngas is that they contain essentially no nitrogen and sulfur and generally contain essentially no aromatic compounds. By way of example, Fischer Tropsch distillate fuels typically contain less than 1 ppm by weight sulfur. Accordingly, they may have minimal health and environmental impact. These Fischer-Tropsch-derived fuels are considered "green fuels" and are desirable as environmentally friendly.

Although sulfur is not environmentally desirable, it may act as a natural antioxidant in hydrocarbonaceous products, such as in petroleum-derived hydrocarbonaceous products, and inhibit oxidation during shipment and storage. Since Fischer Tropsch products contain essentially no sulfur or any other natural antioxidants, Fischer Tropsch products are prone to oxidize.

Resistance to Oxidation

The present invention relates to methods of inhibiting oxidation in Fischer Tropsch derived products.

In petroleum-derived hydrocarbonaceous products, various components, such as aromatics, sulfur, and nitrogen, are present. The sulfur may act as an antioxidant, and thus naturally inhibit oxidation in petroleum-derived hydrocarbonaceous products. Therefore, when using petroleum derived hydrocarbonaceous products, the products may be shipped and stored for a period of time without significant oxidation of the product.

Petroleum-derived hydrocarbonaceous products contain greater than 1 ppm sulfur and may be derived from, for example, conventional petroleum, conventional diesel fuel, conventional solvent, conventional jet fuel, conventional naphtha, conventional lube base stock, conventional lube base oil, and mixtures thereof.

It has been determined that oxidation of Fischer Tropsch products may be inhibited by mixing the Fischer Tropsch products with an effective amount of a petroleum-derived hydrocarbonaceous product. The petroleum-derived hydrocarbonaceous products may contain components that act as antioxidants, such as sulfur. Therefore, the petroleum-derived hydrocarbonaceous products may act as an agent capable of inhibiting oxidation of Fischer Tropsch products when mixed with the Fischer Tropsch products. Fischer Tropsch products may be mixed with an effective amount of a petroleum-derived hydrocarbonaceous product to provide a blended product that resists oxidation. The blended product may be safely stored or transported without the use of additional conventional antioxidants (for example, phenolic compounds or diphenylamine compounds) or with the use of much lower levels of additional, expensive conventional antioxidants. Phenol type (phenolic) oxidation inhibitors include, but are not limited to, such as 4,4'-methylene-bis(2,6-di-tert-butylphenol), 4,4'-bis(2,6-di-tert-butylphenol), 4,4'-bis(2-methyl-6-tertbutylphenol), 2,2'-methylene-bis(4-methyl-6-tert-butyl-phenol), 4,4'-butylidenebis(3-methyl-6-tert-butylphenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,2'-methylene-bis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-I-dimethylamino-p-cresol, 2,6-di-tert-4(N,N'-dimethyl-aminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis(3,5-di-tert-butyl-4-hydroxybenzyl). Diphenylamine-type oxidation inhibitors include, but are not limited to, alkylated diphenylamine, phenyl-α-naphthylamine, and alkylated-a-naphthylamine. Mixtures of compounds may also be used. Antioxidants are added at below 500 ppm, typically below 200 ppm, and most typically from 5 to 100 ppm.

The blended product may have a final peroxide number of less than 5 ppm, preferably less than 3 ppm and most preferably less than 1 ppm after 7 days. The blended product is tested for stability according to standard procedures for measuring the buildup of peroxides according to ASTM D3703-99. ASTM D3703-99 covers the determination of peroxide content of aviation-turbine fuels. ASTM D3703-99 describes a procedure by which the peroxide number expressed as mg of peroxide/kg of sample is determined. In this procedure, a quantity of sample is dissolved in 1,1,2-trichloro-1,2,2-trifluoroethane. This solution is contacted with aqueous potassium iodide solution. The peroxides present are reduced by the potassium iodide. An equivalent amount of iodine is liberated, which is titrated with sodium thiosulfate solution. The results are calculated as milligrams of peroxide per kilogram of sample (ppm). The formation of peroxides indicates the onset of oxidation and provides a measure of oxidative stability.

The formation of peroxides in the sample should be evaluated under conditions similar to the intended transportation or storage conditions. Materials are typically transported or stored as liquids, and should be tested as such. For materials that have pour points below 25° C., the test temperature is 25° C. For materials that have pour points of 25° C. or higher, the test temperature is 10° C. above the pour point. Pour points are measured by ASTM D 97. Sufficient sample to perform the test is place in an open wide mouth bottle and placed in contact with air in an oven maintained at the test temperature for the duration of the test. The sample is removed and portions analyzed for peroxide number, while the remainder of the sample is returned to the oven.

Samples that show an initial high level of peroxide (above 5 ppm) have already been oxidized. These samples should be purified by contact with an adsorbent (alumina) to reduce their initial peroxide number to below 1 prior to performing the oxidation experiments.

An effective amount of petroleum-derived hydrocarbonaceous product to be mixed is the amount that inhibits oxidation sufficiently such that the blended product has a final peroxide number of less than 5 ppm, preferably less than 3 ppm and most preferably less than 1 ppm after 7 days is provided, when tested as described above.

The chemical characteristics of the petroleum-derived hydrocarbonaceous products to be mixed with the Fischer Tropsch products may vary. By way of example, the sulfur contents of petroleum-derived hydrocarbonaceous products may vary. Therefore, the effective amount of petroleum-derived hydrocarbonaceous product to be mixed may vary accordingly, and thus the exact concentration of petroleum-derived hydrocarbonaceous product in the resulting blended product will also vary.

The blended product should contain greater than 1 ppm sulfur in order to exhibit satisfactory oxidation stability. Preferably, the sulfur content of the blended product is as low as possible and still effectively inhibits oxidation. Preferably, the sulfur content range of the blended product is greater than 1 ppm and less than 100 ppm. Since sulfur content of individual petroleum-derived products useful in the method of the present invention may vary, the exact concentration of petroleum-derived hydrocarbonaceous product in the blended product may also vary and will depend on the sulfur content of the petroleum-derived product.

Generally, the petroleum-derived hydrocarbonaceous product may be added in a concentration of approximately 10 to 90 wt %, more preferably 10 to 75 wt %. Most preferably the petroleum-derived hydrocarbonaceous product may be added in a concentration of approximately 10 to 30 wt %. It is preferable to add the petroleum-derived hydrocarbonaceous product in as low of a concentration as possible and still effectively inhibit oxidation.

Petroleum-derived hydrocarbonaceous products are desirable agents for inhibiting oxidation in the present invention due to their high compatibility with Fischer Tropsch derived products. Therefore, Fischer Tropsch products may be readily blended with a petroleum-derived hydrocarbonaceous product during storage and/or transportation to inhibit oxidation. Petroleum-derived hydrocarbonaceous products may be particularly effective in inhibiting oxidation because they reside blended in with the Fischer Tropsch products. Therefore, Fischer Tropsch products may be blended with petroleum-derived hydrocarbonaceous products during storage and/or transportation to inhibit oxidation.

The blended product containing a Fischer Tropsch product and a petroleum-derived hydrocarbonaceous product may be safely stored or transported without the use of additional conventional antioxidants (for example, phenolic compounds, diphenylamine compounds, or mixtures thereof) or with the use of much lower levels of additional, expensive conventional antioxidants. By way of example, the amount of additional, conventional antioxidants to provide a product with a final peroxide number of less than 5 ppm, preferably less than 3 ppm and most preferably less than 1 ppm after 7 days is less in a blend of a Fischer Tropsch product and a petroleum derived product than in a Fischer Tropsch product alone. In a Fischer Tropsch product alone, significantly greater amounts of conventional antioxidants would be required.

Methods of Inhibiting Oxidation

The present invention also relates to methods of inhibiting oxidation of a Fischer Tropsch product. In one method of the present invention, a Fischer Tropsch product is synthesized in a Fischer Tropsch process. The product recovered from a Fischer-Tropsch process may range from $C_5$ to $C_{20+}$ and may be distributed in one or more product fractions. In the Fischer Tropsch process, the desired Fischer Tropsch product typically will be isolated by distillation.

The products from Fischer-Tropsch reactions performed in slurry bed reactors generally include a light reaction product and a waxy reaction product. The light reaction product (i.e. the condensate fraction) includes hydrocarbons boiling below about 700° F. (e.g., tail gases through middle distillates), largely in the $C_5$–$C_{20}$ range, with decreasing amounts up to about $C_{30}$. The waxy reaction product (i.e. the wax fraction) includes hydrocarbons boiling above 600° F. (e.g., vacuum gas oil through heavy paraffins), largely in the $C_{20+}$ range, with decreasing amounts down to $C_{10}$. Both the light reaction product and the waxy product are substantially paraffinic. The waxy product generally comprises greater than 70% normal paraffins, and often greater than 80% normal paraffins. The light reaction product comprises paraffinic products with a significant proportion of alcohols and olefins. In some cases, the light reaction product may comprise as much as 50%, and even higher, alcohols and olefins.

The product from the Fischer-Tropsch process may be further processed using, for example, hydrocracking, hydroisomerization, hydrotreating. Such processes crack the larger synthesized molecules into fuel range and lube range molecules with more desirable boiling points, pour points, and viscosity index properties. Such processes may also saturate oxygenates and olefins to meet the particular needs of a refiner. These processes are well known in the art and do not require further description here.

To the Fischer Tropsch product is added an effective amount of a petroleum-derived hydrocarbonaceous product to provide a product having a final peroxide number of less than 5 ppm, preferably less than 3 ppm, and most preferably less than 1 ppm after 7 days. The petroleum-derived hydrocarbonaceous product is mixed into the Fischer Tropsch product to provide a blended product.

As one of skill in the art would readily understand and be able to devise, the petroleum-derived hydrocarbonaceous product may be added and mixed into the Fischer Tropsch product in a variety of ways. By way of example, the petroleum-derived hydrocarbonaceous product and Fischer Tropsch product may be mixed and then pumped into a storage or transportation device. In addition, the petroleum-derived hydrocarbonaceous product may be added to an empty storage or transportation device and then the Fischer Tropsch product may be added with agitation.

An effective amount of petroleum-derived hydrocarbonaceous product to be mixed is the amount that inhibits oxidation sufficiently such that a blended product having a final peroxide number of less than 5 ppm, preferably less than 3 ppm and most preferably less than 1 ppm after 7 days is provided. The blended product is tested for stability according to standard procedures for measuring the buildup of peroxides according to ASTM D3703-99, as described previously. The formation of peroxides indicates the onset of oxidation and provides a measure of oxidative stability.

A desirable property of Fischer-Tropsch products is that they contain essentially no aromatics or heteroatoms, such as sulfur and nitrogen. Therefore, Fischer-Tropsch liquid products may be used as environmentally friendly green fuels. However, the petroleum derived hydrocarbonaceous products, added to the Fischer-Tropsch products to inhibit oxidation, may add impurities, aromatics, and unwanted heteroatoms (such as sulfur and nitrogen). Therefore, the resulting blended product may contain impurities, aromatics, and unwanted heteroatoms that the original Fischer-Tropsch product did not contain.

Therefore, after the period in which oxidation is to be prevented and before the Fischer-Tropsch liquid products are to be sold/used, it may be desirable to remove or at least reduce the impurities, aromatics, and unwanted heteroatoms (such as sulfur, nitrogen, metals). The impurities, aromatics, and heteroatom content may be reduced by a number of processes. These processes may include hydrotreating, hydrocracking, hydroisomerization, extraction, adsorption, and the like. The preferred methods are those involving processing with hydrogen (i.e., hydrotreating, hydrocracking, and hydroisomerization), with hydrotreating being the most preferred.

Hydrotreating is a process for removing at least a portion of impurities, such as heteroatoms (i.e. sulfur, nitrogen, oxygen) or compounds containing sulfur, nitrogen, or oxygen, from a hydrocarbon product mixture. Typical hydrotreating conditions vary over a wide range. In general, the overall LHSV (Liquid Hourly Space Velocity) is about 0.25 to 2.0 $hr^{-1}$, preferably about 0.5 to 1.0 $hr^{-1}$. The hydrogen partial pressure is greater than 200 psia, preferably ranging from about 500 psia to about 2500 psia. Hydrogen re-circulation rates are typically greater than 50 SCF/Bb1, and are preferably between 1000 and 5000 SCF/Bb1. Temperatures range from about 300° F. to about 750° F., preferably ranging from 450° F. to 600° F.

Therefore, the methods of the present invention may also comprise the step of processing the blended final product to remove at least a portion of any impurities, aromatics, and heteroatoms (such as sulfur, nitrogen, metals) originating from the petroleum derived product. The processing step may involve hydrotreating, hydrocracking, hydroisomerization, extraction, adsorption, and the like, preferably hydrotreating. After processing to remove at least a portion of any impurities, aromatics and heteroatoms (i.e., sulfur), the resulting product preferably has a sulfur content of less than 100 ppm, more preferably less than 10 ppm, and most preferably less than 1 ppm.

If necessary, after the blended final product is processed to remove at least a portion of any impurities, aromatics, and heteroatoms (such as sulfur, nitrogen, metals) originating from the petroleum derived product to provide a salable product, a conventional antioxidant may be incorporated into the salable product if necessary. By way of example, in the case of a Fischer Tropsch lube base oil, once the blended final product is processed, for example, hydrotreated, conventional antioxidants in the additive package can be incorporated to provide antioxidant protection in a salable product. As one of skill in the art would readily understand, similar procedures may be used for Fischer Tropsch diesel fuel and other Fischer Tropsch products.

In another method of the present invention, a Fischer Tropsch product is synthesized in a Fischer Tropsch process. The product recovered from a Fischer-Tropsch process may range from $C_5$ to $C_{20+}$ and may be distributed in one or more product fractions. In the Fischer Tropsch process, the desired Fischer Tropsch product typically will be isolated by distillation.

To the Fischer Tropsch product is added an amount of a petroleum-derived hydrocarbonaceous product to provide a blended product with a sulfur content of greater than 1 ppm. The petroleum-derived hydrocarbonaceous product is mixed into the Fischer Tropsch product to provide a blended product. As one of skill in the art would readily understand and be able to devise, the petroleum-derived hydrocarbonaceous product may be added and mixed into the Fischer Tropsch product in a variety of ways. By way of example, the petroleum-derived hydrocarbonaceous product and Fischer Tropsch product may be mixed and then pumped into a storage or transportation device. In addition, the petroleum-derived hydrocarbonaceous product may be added to an empty storage or transportation device and then the Fischer Tropsch product may be added with agitation.

After the period in which oxidation is to be prevented and before the Fischer-Tropsch products are to be sold/used, the blended product is processed with hydrogen to provide a final product with a sulfur content of less than 100 ppm, preferably less than 10 ppm and most preferably less than 1 ppm.

The step of processing the blended product may involve any process that may be used to remove at least a portion of sulfur and other impurities that originate from the petroleum-derived hydrocarbonaceous component, including for example, hydrotreating, hydrocracking, and hydroisomerization. The processing step may be performed after the period in which oxidation is to be prevented and before use of the products.

An additional aspect of the present invention is a method of inhibiting oxidation of a Fischer Tropsch product comprising synthesizing a Fischer Tropsch product by a Fischer Tropsch process. The product recovered from a Fischer-Tropsch process may range from $C_5$ to $C_{20+}$ and may be distributed in one or more product fractions. In the Fischer Tropsch process, the desired Fischer Tropsch product typically will be isolated by distillation.

A blended hydrocarbonaceous product is created by mixing (i) the Fischer Tropsch product, (ii) a petroleum-derived hydrocarbonaceous product, and (iii) an effective amount of an antioxidant selected from the group consisting of phenolic compounds, diphenylamine compounds, and mixtures thereof, such that the blended hydrocarbonaceous product has a final peroxide number of less than 5 ppm, preferably less than 3 ppm, and most preferably less than 1 ppm after 7 days; and wherein the effective amount of antioxidant in (i) and (ii) is less than the amount that would be required in (i) alone. As one of skill in the art would readily understand and be able to devise, the antioxidant, the Fischer Tropsch product, and the petroleum derived product may be added and mixed in a variety of ways and in any order.

After the period in which oxidation is to be prevented and before the Fischer-Tropsch products are to be sold/used, the blended product may be processed to remove at least a portion of any impurities, aromatics, and heteroatoms (such as sulfur, nitrogen, metals) originating from the petroleum derived product to provide a salable product. The step of processing the blended product may involve any process that may be used to remove at least a portion of sulfur and other impurities that originate from the petroleum-derived hydrocarbonaceous component, including for example, hydrotreating, hydrocracking, and hydroisomerization. The processing step may be performed after the period in which oxidation is to be prevented and before sale or use of the products.

EXAMPLES

The invention will be further explained by the following illustrative examples that are intended to be non-limiting.

Example 1

A hydrocarbon raw material stream at a remote site is obtained from an underground reservoir. The stream is separated into a gaseous product and a liquid product (crude oil). The gaseous product contains sulfur compounds and in particular mercaptans. The mercaptans in the gaseous product are removed by caustic, converted to disulfides by oxidation, and separated from the caustic. The purified gas stream is converted to synthesis gas and further converted to heavier hydrocarbon products by use of the Fischer Tropsch process. The products from the Fischer Tropsch process are blended with the recovered disulfides to form an oxidation-resistant product. Typically this blended product contains more than 1 ppm sulfur in the form of disulfides. The oxidation-resistant product is then shipped to a developed site where the disulfides are separated from the Fischer Tropsch product by distillation.

Example 2

A hydrocarbon raw material stream at a remote site is obtained from an underground reservoir. The stream is separated into a gaseous product and a liquid product (crude oil). The gaseous product contains sulfur compounds and in particular mercaptans. The crude oil also contains sulfur. The mercaptans in the gaseous product are removed by caustic, converted to disulfides by oxidation, and separated from the caustic and discarded. The purified gas stream is converted to synthesis gas and further converted to heavier hydrocarbon products by use of the Fischer Tropsch process. A diesel fuel product derived from the Fischer Tropsch process is blended with a diesel fuel derived from the recovered crude oil to form an oxidation-resistant blended diesel. Typically this blended product contains more than 1 ppm sulfur. The blended product is then shipped to a developed site where the sulfur compounds are removed by hydrotreating. The hydrotreating converts the sulfur compounds into hydrogen sulfide, which is separated from the blended product by distillation.

What is claimed is:

1. A method of inhibiting oxidation of a Fischer Tropsch product during transport and/or storage comprising the steps of:

a) synthesizing a Fischer Tropsch product;

b) adding an effective amount of a petroleum-derived hydrocarbonaceous product to provide a blended product for transport and/or storage having a sulfur content of greater than 1 ppm and less than 100 ppm and having a final peroxide number of less than 5 ppm after 7 days; and c) mixing the petroleum-derived hydrocarbonaceous product into the Fischer Tropsch product to provide the blended product for transport and/or storage.

2. A method of inhibiting oxidation of a Fischer Tropsch product according to claim 1, wherein an effective amount of petroleum-derived hydrocarbonaceous product is added to provide a blended product having a peroxide number of less than 3 ppm after 7 days.

3. A method of inhibiting oxidation of a Fischer Tropsch product according to claim 1, wherein an effective amount of petroleum-derived hydrocarbonaceous product is added to provide a blended product having a peroxide number of less than 1 ppm after 7 days.

4. A method according to claim 1, wherein the effective amount of petroleum-derived hydrocarbonaceous product is from 10 to 75 wt %.

5. A method according to claim 4, wherein the effective amount of petroleum-derived hydrocarbonaceous product is from 10 to 30 wt %.

6. A method according to claim 1, further comprising a step d) processing the blended product with hydrogen to remove at least a portion of sulfur and other impurities that originate from the petroleum-derived hydrocarbonaceous product after the period in which oxidation is to be prevented.

7. A method according to claim 1, further comprising a step d) hydrotreating the blended product to remove at least a portion of sulfur and other impurities that originate from the petroleum-derived hydrocarbonaceous product after the period in which oxidation is to be prevented.

8. A method of inhibiting oxidation of a Fischer Tropsch product during transport and/or storage comprising the steps of:

a) synthesizing a Fischer Tropsch product;

b) adding an effective amount of a petroleum-derived hydrocarbonaceous product which contains sulfur to the Fischer Tropsch product;

c) mixing the petroleum-derived hydrocarbonaceous product into the Fischer Tropsch product to provide a blended product for transport and/or storage having a final peroxide number of less than 5 ppm after 7 days; and d) processing the blended product with hydrogen after the transport and/or storage period in which oxidation is to be prevented to provide a final product with a sulfur content of less than 100 ppm.

9. A method according to claim 8, wherein the final product has a sulfur content of less than 10 ppm.

10. A method according to claim 8, wherein the final product has a sulfur content of less than 1 ppm.

11. A method according to claim 8, wherein the processing is performed by hydrotreating.

12. A method of inhibiting oxidation of a Fischer Tropsch product during transport and/or storage comprising the steps of:

a) synthesizing a Fischer Tropsch product; and b) creating a blended hydrocarbonaceous product for transport and/or storage by mixing (i) the Fischer Tropsch product, (ii) an effective amount of sulfur-containing petroleum-derived hydrocarbonaceous product, and (iii) an effective amount of an antioxidant selected from the group consisting of phenolic compounds, diphenylamine compounds, and combinations thereof, such that the blended hydrocarbonaceous product has a final peroxide number of less than 5 ppm after 7 days;

wherein the effective amount of antioxidant in (i) and (ii) is less than the amount that would be required in (i) alone.

13. A method of inhibiting oxidation of a Fischer Tropsch product according to claim 12, wherein the blended hydrocarbonaceous product has a peroxide number of less than 3 ppm after 7 days.

14. A method of inhibiting oxidation of a Fischer Tropsch product according to claim 12, wherein the blended hydrocarbonaceous product has a peroxide number of less than 1 ppm after 7 days.

15. A method according to claim 12, further comprising a step c) processing the blended product with hydrogen to remove at least a portion of sulfur and other impurities that originate from the petroleum-derived hydrocarbonaceous product after the period in which oxidation is to be prevented.

16. A method according to claim 12, further comprising a step c) hydrotreating the blended product to remove at least a portion of sulfur and other impurities that originate from the petroleum-derived hydrocarbonaceous product after the period in which oxidation is to be prevented.

* * * * *